US005467535A

United States Patent [19]

Lentz

[11] Patent Number: 5,467,535

[45] Date of Patent: Nov. 21, 1995

[54] MOISTURE EQUALIZER FOR A CONTINUOUS FLOW GRAIN DRYER

[75] Inventor: Thomas D. Lentz, Zionsville, Ind.

[73] Assignee: Beard Industries, Inc., Frankfort, Ind.

[21] Appl. No.: 248,600

[22] Filed: May 25, 1994

[51] Int. Cl.[6] ..... F26B 17/12

[52] U.S. Cl. ..... 34/168; 34/174; 34/171

[58] Field of Search ..... 34/168, 169, 174, 34/171, 172, 178, 167; 432/14

[56] References Cited

U.S. PATENT DOCUMENTS

| | | | |
|---|---|---|---|
| 4,149,844 | 4/1979 | Noyes | 432/17 |
| 4,242,806 | 1/1981 | McClaren | 34/174 |
| 4,249,891 | 2/1981 | Noyes | 432/14 |
| 4,268,971 | 5/1981 | Noyes | 34/169 |
| 4,404,756 | 9/1983 | Noyes | 34/169 |
| 5,233,766 | 8/1993 | Frederiksen et al. | 34/174 |

OTHER PUBLICATIONS

Copy—9 pages of document by Qin Zhang and J. Bruce Litchfield entitled Measurement Of Temperature And Moisture Profiles Within A Crossflow Dryer: Temperature As An Indication Of Moisture Removal—Dated Dec. 14–17, 1993.

*Primary Examiner*—Denise L. Gromada
*Attorney, Agent, or Firm*—Henderson & Sturm

[57] ABSTRACT

A grain drying apparatus of a type including, a pair of spaced apart air pervious walls for confining a column of grain to be dried. A plenum chamber is formed on one side of the innermost of the air pervious walls. A blower or the like is provided for causing heated air from said plenum chamber to pass through the spaced air pervious walls and therefore through said column of grain to be dried. A grain diverting plate is disposed between and spaced from the spaced air pervious walls. A first portion of the plate which is closest to the innermost air pervious wall is higher than a second portion of said plate which is closest to the outermost air pervious wall. This creates a void under the angled plate. The angle of the plate is steep enough to allow grain to flow against it on the bottom side, therefore grain will completely flow into and fill the void. The grain next to the outside skin of the dryer is restricted into a funnel with the outlet being smaller than the inlet. This causes a slower grain velocity channel to form in this region. The side of the funnel also creates a boundary not allowing grain next to the outside wall of the dryer to flow into the void area under the plate. Because the plate is angled up towards the inside skin of the dryer, the grain next to the inside skin of the dryer will flow around the plate and into the void first. This grain next to the inside skin forms a higher velocity grain channel. The net effect of the higher velocity channel which is formed next to the inside skin and the slower velocity channel which is formed next to the outside skin is that the grain next to the inside skin is displaced farther down the column than the grain next to the outside skin. This effect is only created in the region around the moisture equalizer device. The regions inside the column above and below the moisture equalizer device are in mass flow condition with all grain moving down the column at the same velocity at any specific horizontal cross section.

17 Claims, 3 Drawing Sheets

MOISTURE EQUALIZER FOR A CONTINUOUS FLOW GRAIN DRYER

TECHNICAL FIELD

The present invention relates generally to grain drying equipment and more, particularly to an improved continuous crossflow column grain dryer with improved specific grain mass flow within the grain column.

BACKGROUND ART

The present invention relates to a grain drying and conditioning apparatus of a continuous flow type having air inlet, grain inlet, grain outlet and spaced air pervious walls for confining a column of grain to be dried. A blower and burner mechanism is also connected to the apparatus for causing heated air to be forced into a plenum chamber inside the inner pervious wall and through the column of grain to heat and extract moisture therefrom.

In a typical crossflow column grain dryer discussed by Litchfield & Zhang, ASEA 936511, typically a "drying front" moves through the mass in the column as the material moves through the dryer. There is a relationship between the temperature of the product mass in a column and moisture removal. It has long been known that when the drying front has passed completely through a column there will be a simultaneous increase in the temperature of the exhaust air because of decreased evaporative cooling of the air.

Studies show that corn drying in a typical crossflow dryer column is a three-phase process: start-up heating, dominant drying, and tail-drying heating phases. Two-step temperature increase was caused by uneven energy distribution drying at different phases of the drying. At first, wet corn needed to be heated to a certain level to build a temperature gradient within kernels to generate moisture migration force. During this period, most of the energy supplied by the drying-air was used to warm up the corn, and a rapid increase of corn temperature resulted. This period was the start-up heating phase in which the corn mass underwent a significant temperature increase and a slight moisture loss.

After the temperature gradient in kernels was built up, a constant rate of moisture migration could be generated. The point undergoing the first significant temperature increase was defined as the drying front. The drying front indicated the start of the dominant drying phase, in which most of the heat carried by drying-air was used to evaporate moisture from kernels, and the corn mass underwent a significant moisture loss and a relatively small temperature increase.

The drying front always begins in the column area closest to the drying air source.

When the amount of moisture that could be migrated from kernels was less than could be carried by the drying-air, the moisture removal rate was slowed down. Most of the heat was again used to heat corn, and caused another rapid increase in corn mass temperature. The point undergoing the second significant temperature increase was defined as the end of the drying front. Too much time in the dryer after the dominant drying phase can cause overheating and overdrying of the grain.

The end of drying occurs first in the column area closest to the drying air source, and therefore overheating of grain occurs first in this area.

It is also known that conventional continuous flow column grain drying devices are limited in their maximum plenum temperatures and therefore in their drying efficiency because of the kernel temperature limits of the layer of grain that is continuously exposed to the hot plenum air as the grain moves downward sliding against the inner perforated grain column wall that forms the plenum chamber walls, particularly after the end of the drying front. There is, therefore, a need for equipment of this type which will overcome this kernel temperature limitation and improve drying efficiency by providing a design that limits the amount of time that a given layer of grain can move in direct contact with the heat plenum wall. Also, it allows dry grain to move out of the dryer without being overdried.

DISCLOSURE OF THE INVENTION

The present invention relates to a grain drying apparatus of a type including, a pair of spaced apart air pervious walls for confining a column of grain to be dried. A grain column with a fixed width is created between two fixed boundary sheets called dryer skin. The skin sheets will be considered inner and outer skin, because in general one skin sheet is closer to the inside part of the dryer where the warm drying air is generated and one sheet is nearer to the outside part of the dryer. The height and horizontal length as well as the shape of the column are variable within different models of dryers. A plenum chamber is formed on one side of the innermost of the air pervious walls.

A blower or the like is provided for causing heated air from said plenum chamber to pass through the spaced air pervious walls and therefore through said column of grain to be dried. A grain diverting plate is disposed between and spaced from the spaced air pervious walls.

A fixed or adjustable angled plate runs in a horizontal fashion inside the column (that is between the inner and outer skin sheets). The angle plate is mounted in a direction which is perpendicular to the grain flow and parallel with the inner and outer perforated skin sheets (on units with curved skin sheets, the plate follows the curve of the skin). The top most leading edge of the angled plate is always on the same side as the inner skin sheets (next to the drying plenum). The angled plate does not make contact with the dryer skin, but is suspended between the inner and outer skin sheets.

A secondary part of the apparatus is an added vertical plate which has its bottom edge attached to the top most leading edge of the angled plate. A first portion of the angled plate which is closest to the innermost air pervious wall is higher than a second portion of said plate which is closest to the outermost air pervious wall whereby grain flows on both sides of the diverter plate.

So that the hottest and driest grain in the column of grain which is closest to the innermost wall will flow faster than the cooler, wetter grain in the column of grain which is farther away from the innermost wall.

Grain flows by gravity inside the column from top to bottom. Above and below the moisture equalizer, the flow of grain is considered to be mass flow, that is, all of the kernels of grain inside the column tend to flow at the same velocity (or have the same vertical displacement over a given period of time). This mass flow condition occurs naturally because of the relative narrow width of the column relative to the large height of the column. As it has been discussed, it is desirable to have the warmest grain next to the inside skin move through the dryer more quickly than the grain next to the outside skin.

The apparatus described above creates a void under the angled plate. The angle of the plate is steep enough to allow grain to flow against it on the bottom side, therefore grain will completely flow into and fill the void. The grain next to the outside skin of the dryer is restricted into a funnel with the outlet being smaller than the inlet. This causes a slower grain velocity channel to form in this region. The side of the funnel also creates a boundary not allowing grain next to the outside wall of the dryer to flow into the void area under the plate. Because the plate is angled up towards the inside skin of the dryer, the grain next to the inside skin of the dryer will flow around the plate and into the void first. This grain next to the inside skin forms a higher velocity grain channel. The net effect of the higher velocity channel which is formed next to the inside skin and the slower velocity channel which is formed next to the outside skin is that the grain next to the inside skin is displaced farther down the column than the grain next to the outside skin. This effect is only created in the region around the moisture equalizer device. The regions inside the column above and below the moisture equalizer device are in mass flow condition with all grain moving down the column at the same velocity at any specific horizontal cross section. The plate apparatus material is structural steel or other suitable material, either solid or perforated.

It has been found that the amount of displacement differential which occurs through the moisture equalizer is dependent on the following variables. (a) The angle of the angled plate does have an effect on the amount of displacement differential grain movement which occurs. Too flat of an angle will create a stagnation zone above the plate which tends to cause a funnel restriction on both sides of the plate. Also, below the plate, an air void forms which does not fill with grain and therefore promotes less movement of the grain next to the inside wall. Too steep of an angle tends to allow grain on both sides of the column to flow through without creating significant velocity channels. The optimum angle depends somewhat on grain type and moisture content, but testing shows the optimum angle to be in the range of 40 to 50 degrees from horizontal. (b) The width of the angled plate also has a bearing on the amount of displacement differential. Narrower plates tend to decrease the amount of displacement while wider plates tend to increase the amount of displacement. Of course, there is a point at which the increased width of the angled plate behaves more as an obstruction in the grain column rather than a differential flow device. (c) An additional component of the apparatus which creates additional flow differential in the column is the addition of a vertical plate with the bottom edge of the plate attached to the top most leading edge of the angled plate. The addition of this short vertical plate has the effect to move the shear line of the higher velocity grain channel closer to the inside skin. Less volume of grain (only the grain closer to the inner skin) is drawn into the higher velocity channel but the same void size under the angled plate exists. Therefore, the velocity of the grain next to the inside skin is higher and the displacement of this grain relative to the grain next to the outside column is greater.

There is also a noted mixing effect which occurs in the moisture equalizer region. Because the higher velocity channel occurs primarily in the inner half of the column, but the void area under the plate extends nearly ⅔ of the way across the column, the inner half of the column is distributed to the inner ⅔ of the column after passing through the moisture equalizer. Also, the higher velocity channel creates a mixing effect which distributes any mass of grain in a wider region vertically than was present in areas above the moisture equalizer.

One or more levels of moisture equalizer apparatus are used for moving the innermost and warmest grain down the column faster than it would without the moisture equalizer apparatus. This improves the grain quality, uniformity of grain moisture, and improves drying efficiency significantly by not overdrying the portion of the grain column nearest the inner pervious wall to reach a desired "average" final moisture level.

BEST MODES FOR CARRYING OUT THE INVENTION

Figure 1:
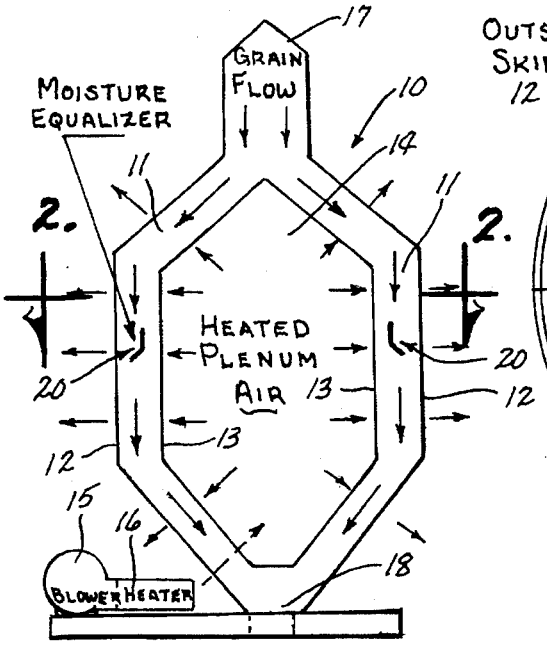
FIG. 1 is a cross sectional view through a continuous flow, cross flow grain dryer.

Referring now to the drawings wherein like reference numerals designate identical or corresponding parts throughout the several views, FIG. 1 shows a continuous/cross flow dryer (10) in one of its simplest forms. The dryer (10) has a grain column (11) formed between an outer perforated wall (12) and an inner perforated wall (13). A plenum chamber (14) is formed inside the air pervious inner wall (13) and is pressurized by a blower (15), blowing air which is heated by a heater (16) into the plenum (14). This causes heated air to pass through the inner walls (13), the grain column (11) and the outer perforated wall (12) as the grain in grain column (11) passes down from the inlet (17) to the outlet (18) of the grain dryer (10). A moisture equalizer (20) is disposed in the grain column (11) between the outer and inner walls (12) and (13) thereof. In the embodiment shown in FIGS. 1, 2 and 3, the moisture equalizer (20) includes an angled plate (21), and optionally, an upwardly extending vertical portion (22) which may optionally have openings or perforations (23) therein. Additionally, the angled plate (21) can also be perforated to allow airflow therethrough if desired. Moisture equalizers (20) are held in place between walls (12 and 13) by angle support plates (24).

Figure 2:
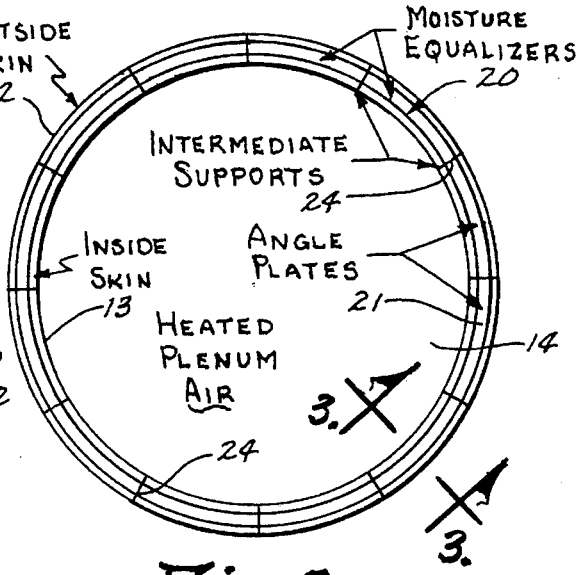
FIG. 2 is a cross sectional view taken along line 2—2 of FIG. 1.
Figure 3:
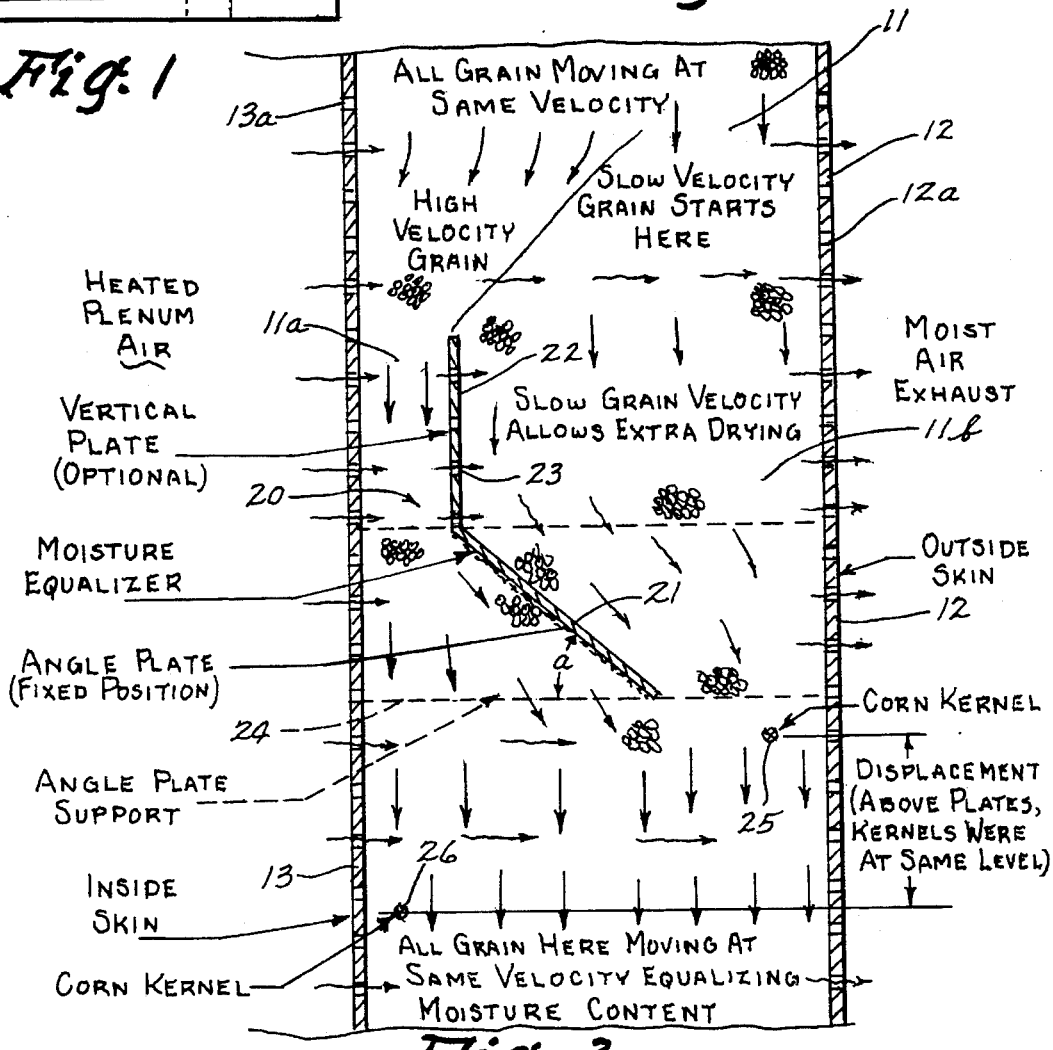
FIG. 3 is an enlarged cross sectional view taken along line 3—3 of FIG. 2.

Referring to FIG. 2, it is noted that the moisture equalizers (20) are supported by intermediate supports (24) which connect to the outer wall (12) and the inner wall (13) and of course to the equalizer (20) so as to hold it fixed in the position shown in FIGS. 1, 2 and 3.

In operation of the embodiment shown in FIG. 1, grain would continuously enter the top portion (17) of the grain dryer (10) and continuously exit the outlet portion (18) of the grain dryer (10), for example by using augers or the like. At the same time the blower (15) and heater or burner (16) would be in operation to make the plenum air hot and pressurized. The grain would be dried as it flows downwardly from the inlet (17) to the outlet (18) but as is usual in these types of dryers as mentioned above, the grain closest to the inner wall (13) will dry faster and become warmer than the grain closer to the outer perforated wall (12). Consequently, by using the moisture equalizer (20) in the grain column (11), it will cause the grain to the right of the angle plate (21) to move more slowly than the grain to the left of the vertical portion (22). Consequently, the grain portion (11*a*) will move much faster down past the moisture equalizer (20) than the grain at (11*b*). This is desired because the grain at (11*a*), since it is hotter and dryer, will not be subjected to the heated air for as long as the grain at (11*b*) which is cooler and wetter. This means the cooler and wetter grain will be subjected to heating air from the plenum chamber longer than the grain passing through portion (11*a*). As the grain in (11*a*) passes down past the equalizer (20), it will begin to travel at about the same speed again all the way across the grain column (11) after some of the faster grain going through portion (11*a*) mixes with grain going down through portion (11*b*) of the column (11).

As explained above, the angle "a" between horizontal and the plate (21) is optimally forty to fifty degrees, although other angles can be used.

It is noted that the corn kernel (25) which passed down through the area (11*b*) will always be above the corn kernel (26), even though the corn kernels (25) and (26) started out at the same level above the grain equalizer (20).

As the kernels mix together below the moisture equalizer, the hot and cold kernels will mix together and the heat transfer from the hot to the cold kernels will cause additional drying in the colder, wetter kernels (25).

Referring again to FIG. 1, it is noted that there could be another moisture equalizer completely around the column of grain (11) directly above the one shown and there could also be another moisture equalizer (20) below the moisture equalizer (20) shown in the grain column (11).

Figure 4:
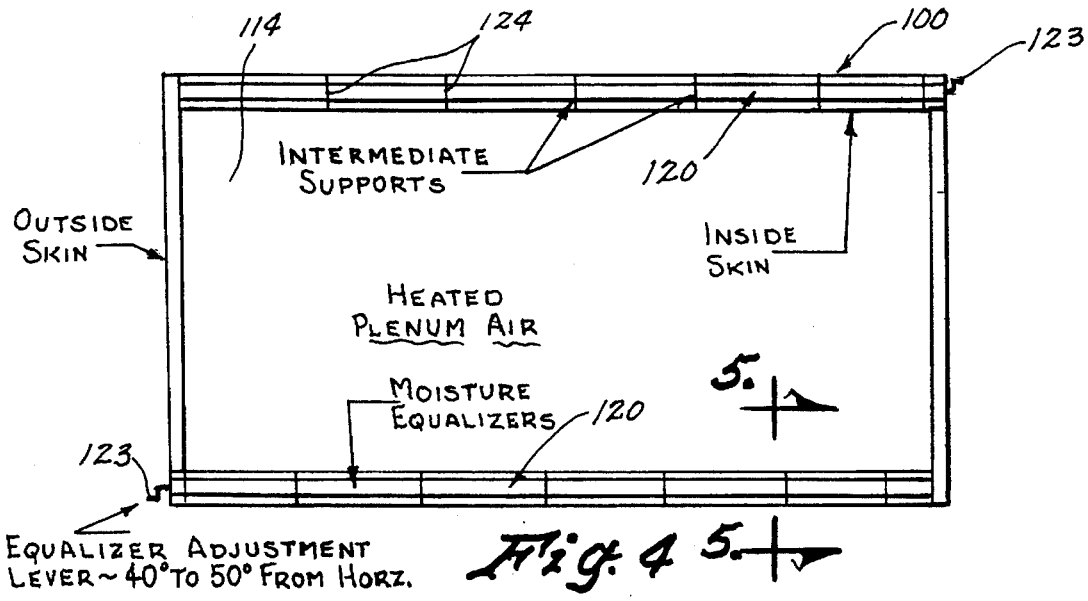
FIG. 4 is a cross sectional view similar to the cross sectional view 2—2 in a grain dryer having a non-circular configuration.
Figure 5:
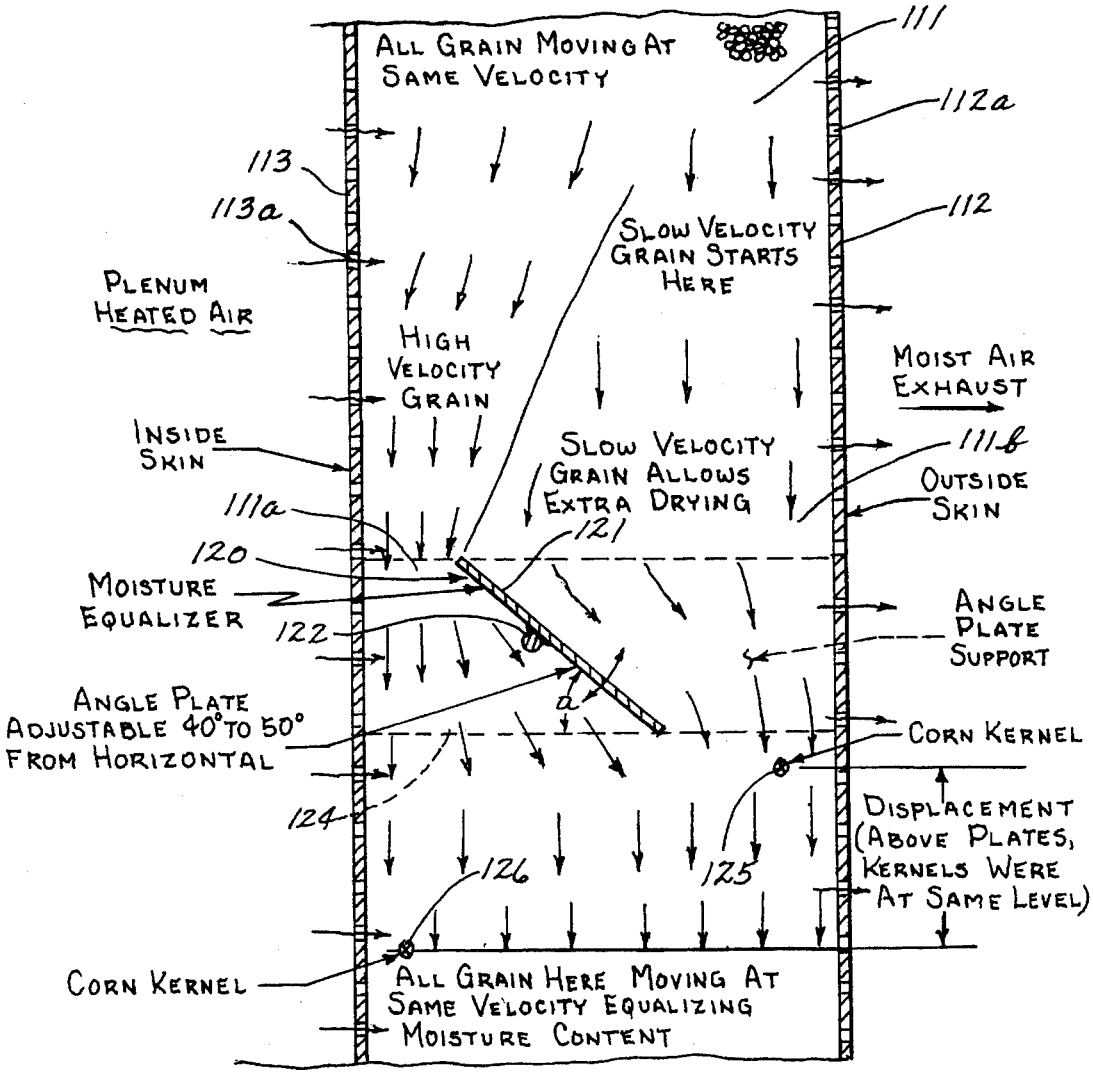
FIG. 5 is an enlarged cross sectional view taken along line 5—5 of FIG. 4.
Figure 6:
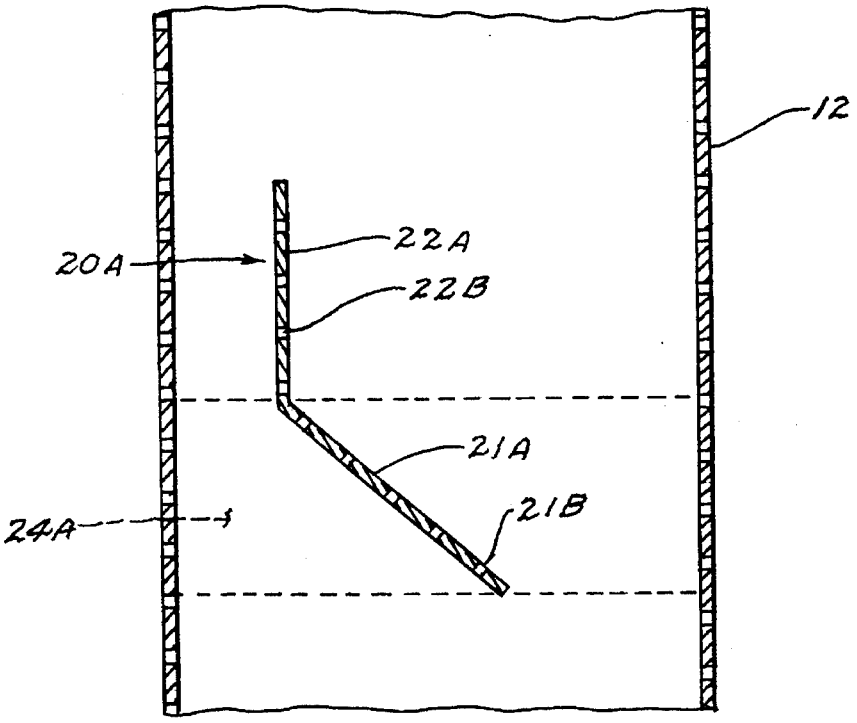
FIG. 6 is a view like FIG. 3 but showing perforations in the grain diverter plate in order to allow air flow therethrough.
Figure 7:
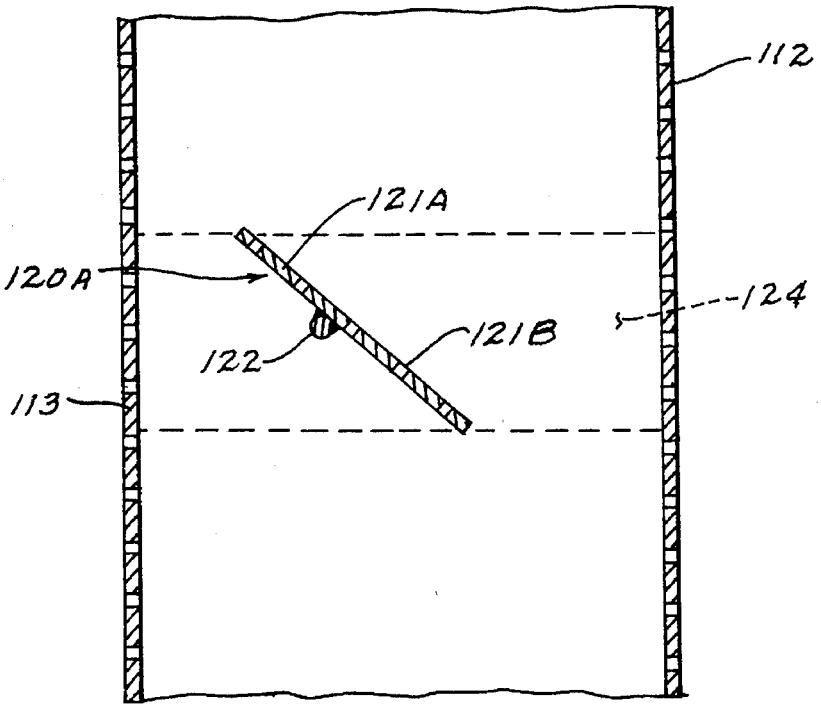
FIG. 7 is a view like FIG. 5, but showing diverter (120A) with plate (121A) having perforations (121B) so that air from wall (112) to wall (113) will allow flow through openings (121B). Axle (122) allows the plate (121A) to be pivoted to adjust the grain flow.

Referring now to FIGS. 4 and 5, it is noted that the cross sectional shape shown in FIG. 4 can be in a device which is precisely the shape of the device shown in FIG. 1, but being long and straight, rather than curved in configuration as in the embodiment shown in FIG. 2. Consequently, the dryer shown in FIG. 4 will be designated by numeral (100), understanding that it will look just like the embodiment (10) of FIG. 1, if viewed from the end thereof. Of course other configurations can be used without departing from the spirit and scope of the invention.

Referring to FIG. 5, it is noted that the outer wall (112) has openings or perforations (112*a*) therein and the inner wall (113) has perforations (113*a*) therein. The moisture equalizer (120) is a plate (121) which is attached to a shaft (122). The plate extends the entire length of one side of the dryer and having an adjusting mechanism (123) on at least one end thereof. Moisture equalizers (120) are pivotally held in place between walls (112 and 113) by angle support plates (124). This allows the plate (121) to be moved to any position desired. It can make the plate (121) completely vertical for allowing trash to be cleaned out of the grain column (111 ), but in operation, the angle "a" of plate (121) would be adjusted so that it can operate in a fashion similar to that disclosed in the embodiment (10) shown in FIGS. 1–3. For example, the kernel (125) and (126) which would start out at the same level directly above where it is shown in FIG. 5 would end up at different levels in the grain column because the flow of grain at (111*a*) adjacent the inner wall (113) would be much faster than the flow of grain at (111*b*). Obviously the more the plate (121) is pivoted towards a vertical position, the more the grain at (111*a*) will approximate the speed of the grain at (111*b*).

Obviously, many modifications and variations of the present invention are possible in light of the above teachings. For example, the FIG. 3 diverter plate could be on the FIG. 4 dryer and it could be pivotally attached for cleaning purposes. It is therefore to be understood that, within the scope of the appended claims, the invention may be practiced otherwise than as specifically described.

I claim:

1. Grain drying apparatus comprising:

a pair of spaced apart air pervious walls for confining a column of grain to be dried;

a plenum chamber formed on one side of the outside of one of said air pervious walls;

means for causing heated air from said plenum chamber to pass through said spaced air pervious walls and therefore through said column of grain to be dried; and a grain diverting plate disposed between and spaced from said spaced air pervious walls defining a first grain flow passage between said grain diverting plate and said one air pervious wall and a second grain flow passage between said grain diverting plate and the other one of said air pervious walls, a first portion of said plate which is closest to said plenum chamber being higher than a second portion of said plate which is closest to said other air pervious wall, whereby the grain will flow faster in said column in the area between said one wall and said first portion of said plate than the grain in said grain column which is disposed between said second portion of said plate and said other other air pervious wall so that the hottest and driest grain in said column which is closest to said one wall will flow faster than the cooler, wetter grain in said column of grain which is farther away from said one wall.

2. The apparatus of claim 1 wherein said plate is impervious to airflow.

3. The apparatus of claim 1 wherein said plate is perforated so as to allow airflow therethrough.

4. The apparatus of claim 1 including means for selectively adjusting the angle of said plate whereby the velocity of downward flow of grain in said grain column can be varied from the inside thereof with respect to the outside thereof.

5. The apparatus of claim 4 including means for adjusting said plate to a vertical position for cleaning trash out of said grain column.

6. The apparatus of claim 1 wherein said plate includes a vertical portion connected to said first portion thereof, said vertical portion extending substantially parallel to said one air pervious wall.

7. The apparatus of claim 6 wherein said plate is impervious to airflow.

8. The apparatus of claim 6 wherein said plate is perforated so as to allow airflow therethrough.

9. The apparatus of claim 1 wherein said grain column includes a width, a height and a length and said plate extends substantially the entire length of said grain column.

10. The apparatus of claim 9 wherein at least a portion of said grain column is cylindrical and wherein said length is in the shape of a circle.

11. The apparatus of claim 1 wherein the angle of said plate is approximately in a range of between 40 and 50 degrees from horizontal.

12. The apparatus of claim 1 including one or more additional grain diverting plates disposed below the first said grain diverting plate for further diverting grain as it flows down between said pair of spaced apart air pervious walls.

13. Grain drying apparatus comprising:

a pair of spaced apart pervious walls for confining a column of grain to be dried;

a plenum chamber formed on one side of the outside of one of said air pervious walls;

means for causing heated air from said plenum chamber to pass though said spaced air pervious walls and therefore through said column of grain to be dried;

a grain diverting plate disposed between and spaced from said spaced air pervious walls, a first portion of said plate which is closest to said one air pervious wall being higher than a second portion of said plate which is closest to said other air pervious wall; and means for permitting the flow of grain between said first portion of said plate and said one air pervious wall, whereby the grain will flow faster in said column in the area between said one wall and said first portion of said plate than the grain in said grain column which is disposed between said second portion of said plate and said other air pervious wall so that the hottest and driest grain in said column which is closest to said one wall will flow faster than the cooler, wetter grain in said column of grain which is farther away from said one wall.

14. Grain drying apparatus comprising:

a pair of spaced apart air pervious walls for confining a column of grain to be dried;

a plenum chamber formed on one side of the outside of one of said air pervious walls;

means for causing heated air from said plenum chamber to pass through said spaced air pervious walls and therefore through said column of grain to be dried; and a grain diverting plate disposed between and spaced from said spaced air pervious walls, a first portion of said plate which is closest to said one air pervious wall being higher than a second portion of said plate which is closest to the other air pervious wall; and means for permitting the flow of grain downwardly on both sides of said grain diverting plate whereby the grain will flow faster in said column in the area between said one wall and said first portion of said plate than the grain in said grain column which is disposed between said second portion of said plate and said other air pervious wall so that the hottest and driest grain in said column which is closest to said one wall will flow faster than the cooler, wetter grain in said column of grain which is farther away from said one wall.

15. Grain drying apparatus comprising:

a pair of spaced apart air pervious walls for confining a column of grain to be dried;

a plenum chamber formed on one side of the outside of one of said air pervious walls;

means for causing heated air from said plenum chamber to pass through said spaced air pervious walls and therefore through said column of grain to be dried;

flow control means for causing the grain to flow faster in said column in the area between said one wall and said first portion of said plate than the grain in said grain column which is disposed between said second portion of said plate and said other air pervious wall so that the hottest and driest grain in said column which is closest to said one wall will flow faster than the cooler, wetter grain in said column of grain which is farther away from said one wall.

16. The apparatus of claim 15 wherein said flow control means comprises a grain diverting plate disposed between and spaced from said spaced air pervious walls, a first portion of said plate which is closest to said one air pervious wall being higher than a second portion of said plate which is closest to said other air pervious wall.

17. Grain drying apparatus comprising:

a pair of spaced apart air pervious walls for confining a column of grain to be dried;

a plenum chamber formed on one side of the outside of one of said air pervious walls;

means for causing heated air from said plenum chamber to pass through said spaced air pervious walls and therefore through said column of grain to be dried; and a grain diverting plate disposed between and spaced from said spaced air pervious walls defining a first grain flow passage between said grain diverting plate and said one air pervious wall and a second grain flow passage between said grain diverting plate and the other one of said air pervious walls, a first portion of said plate which is closest to said one air pervious wall being higher than a second portion of said plate which is closest to the other air pervious wall, whereby the grain will flow faster in said column in the area between said one wall and said first portion of said portion of said plate than the grain in said grain column which is disposed between said second portion of said plate and said other air pervious wall so that the hottest and driest grain in said column which is closest to said one wall will flow faster than the cooler, wetter grain in said column of grain which is farther away from said one wall; and wherein said grain diverting plate extends substantially continuously throughout the entire column of grain defined by the entire length of spaced apart air pervious walls whereby substantially all of the grain in said grain drying apparatus will be diverted in the same homogeneous manner at the level of said grain diverting plate.

* * * * *